US009748674B2

(12) United States Patent
Xu et al.

(10) Patent No.: US 9,748,674 B2
(45) **Date of Patent: *Aug. 29, 2017**

(54) CONNECTION TERMINAL FOR CONNECTING CABLE

(71) Applicant: Tyco Electronics (Shanghai) Co. Ltd., Shanghai (CN)

(72) Inventors: Xiang Xu, Shanghai (CN); Ming Shi, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/640,947

(22) Filed: Mar. 6, 2015

(65) Prior Publication Data

US 2015/0255923 A1 Sep. 10, 2015

(30) Foreign Application Priority Data

Mar. 6, 2014 (CN) ..... 2014 2 0101981

(51) Int. Cl.
*H01R 4/24* (2006.01)
*H01R 4/48* (2006.01)
*H01R 13/28* (2006.01)

(52) U.S. Cl.
CPC ..... *H01R 4/4836* (2013.01); *H01R 13/28* (2013.01)

(58) Field of Classification Search
CPC ..... H01R 13/28; H01R 4/4818; H01R 13/111
USPC ..... 439/290–295, 441, 948
See application file for complete search history.

(56) References Cited

U.S. PATENT DOCUMENTS 3,011,143 A * 11/1961 Dean ..... H01R 13/28 439/291
3,208,030 A * 9/1965 Evans ..... H01R 13/28 439/290
3,530,428 A * 9/1970 Zak ..... H01R 13/432 439/872
3,846,735 A * 11/1974 Carter ..... H01R 13/28 439/284
4,061,406 A * 12/1977 Kunkle ..... H01R 13/28 439/291
4,084,876 A * 4/1978 Dinger ..... H01R 4/4818 439/439
4,537,456 A * 8/1985 Brown ..... H01R 4/2466 439/293
4,552,425 A * 11/1985 Billman ..... H01R 13/28 439/295
4,560,231 A * 12/1985 Shirai ..... H01R 13/114 439/843
4,963,102 A * 10/1990 Gettig ..... H01R 13/28 439/291
5,035,639 A * 7/1991 Kilpatrick ..... H01R 13/28 439/290

(Continued)

*Primary Examiner* — Thanh Tam Le
(74) *Attorney, Agent, or Firm* — Barley Snyder

(57) ABSTRACT

A connection terminal for releaseably connecting a cable is disclosed having a terminal body, a contact arm, a cable fastening member, and a cable releasing member. The terminal body has a mating end and an opposite terminating end. The contact arm extends continuously from the mating end of the terminal body. The cable fastening member is positioned on the terminating end of the terminal body. The cable releasing member is positioned on the cable fastening member.

20 Claims, 6 Drawing Sheets

(56) References Cited

U.S. PATENT DOCUMENTS 5,035,648 A * 7/1991 Kuiper-Moore ..... H01R 13/424 439/595
5,275,620 A * 1/1994 Darby ..... A61N 1/3752 439/441
5,453,028 A * 9/1995 Grambley ..... H01R 4/4827 439/441
5,679,021 A * 10/1997 Kramer ..... H01R 4/4845 439/789
7,001,194 B2 * 2/2006 Yang ..... H01R 23/27 439/295
7,056,158 B2 * 6/2006 Kuroda ..... H01R 13/432 439/748
7,153,152 B1 * 12/2006 Eby ..... H01R 4/185 439/295
7,264,518 B2 * 9/2007 Ellis ..... H01R 13/114 439/595
7,374,465 B2 * 5/2008 Tanaka ..... H01R 13/113 439/595
7,402,064 B2 * 7/2008 Daily ..... H01R 13/113 439/290
7,607,953 B2 * 10/2009 Fabian ..... H01R 4/4818 439/789
7,628,630 B2 * 12/2009 Chang ..... H01R 13/426 439/295
7,651,363 B2 * 1/2010 Koellmann ..... H01R 13/112 439/441
7,794,257 B2 * 9/2010 Rozet ..... H01R 13/05 439/290
7,993,156 B2 * 8/2011 Holste ..... H01R 4/4836 439/441
8,323,049 B2 * 12/2012 Ngo ..... H01R 13/6275 439/552
8,882,533 B2 * 11/2014 Brandberg ..... H01R 13/193 439/441
8,944,836 B2 * 2/2015 Mori ..... H01R 11/11 439/290
2015/0255890 A1 * 9/2015 Xu ..... H01R 4/4836 439/680

* cited by examiner

CONNECTION TERMINAL FOR CONNECTING CABLE

CROSS-REFERENCE TO RELATED APPLICATION

This application claims priority under 35 U.S.C. §119(a)-(d) to Chinese Patent Application No. 201420101981.4, dated Mar. 6, 2014.

FIELD OF THE INVENTION

The invention is generally related to an electrical connector, and, more specifically, to an electrical connector having a reusable connection terminal.

BACKGROUND

In electronic devices, to establish an electrical connection between two cables, the two cables are generally connected to a plug connector and a socket connector, respectively. The electrical connection of two cables is accomplished by the mutual mating between the plug connector and the socket connector.

Both the conventional plug connector and the socket connector include a housing and connection terminals mounted inside the housing. To facilitate a smooth mating operation, the cable is electrically connected to the connection terminal, where at least one terminating portion of the connection terminal is fixed to a conductor element of the cable. However, the conventional connection terminals are generally designed for single use. If maintenance is required after the insertion of the cable into the connector, the connection terminal or the whole connector generally must be replaced, creating unnecessary waste and increasing cost.

There is a need for an electrical connector having a connection terminal where the cable may be removed from the connection assembly through a simple operation, and where the connection terminal may be reused.

SUMMARY

A connection terminal for releaseably connecting a cable has a terminal body, a contact arm, a cable fastening member, and a cable releasing member. The terminal body has a mating end and an opposite terminating end. The contact arm extends continuously from the mating end of the terminal body. The cable fastening member is positioned on the terminating end of the terminal body. The cable releasing member is positioned on the cable fastening member.

BRIEF DESCRIPTION OF THE DRAWINGS

The invention will now be described by way of example, with reference to the accompanying Figures, of which.

DETAILED DESCRIPTION OF THE PREFERRED EMBODIMENTS

Figure 1:
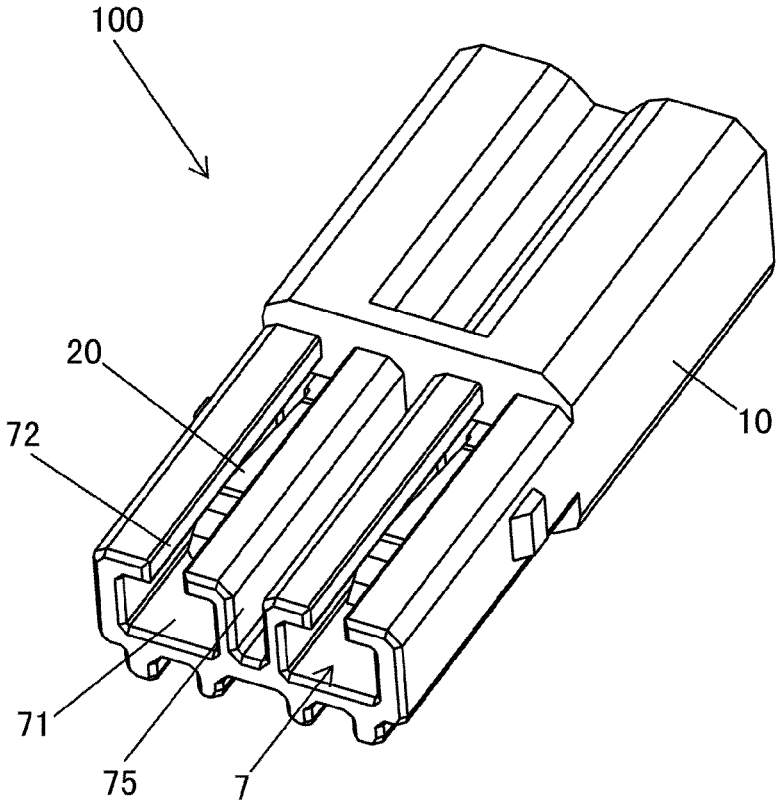
FIG. 1 is a perspective view of a first side of a plug connector.

Although exemplary embodiments will be described hereinafter in detail, with reference to the attached drawings, one of ordinary skill in the art would appreciate that modifications may be made without departing from the spirit and scope of the invention. Thus, it should be appreciated that the following description is a broad teaching for those of ordinary skill in the art, and the content herein is not intended to limit the disclosure to the embodiments set forth.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
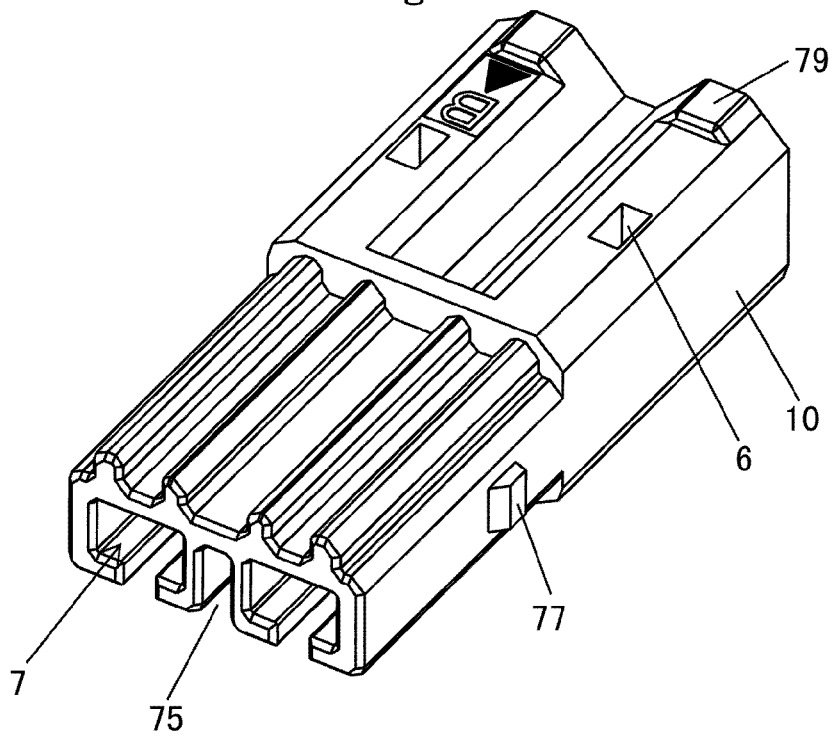
FIG. 2 is another schematic perspective view of a second side of the plug connector.
Figure 3:
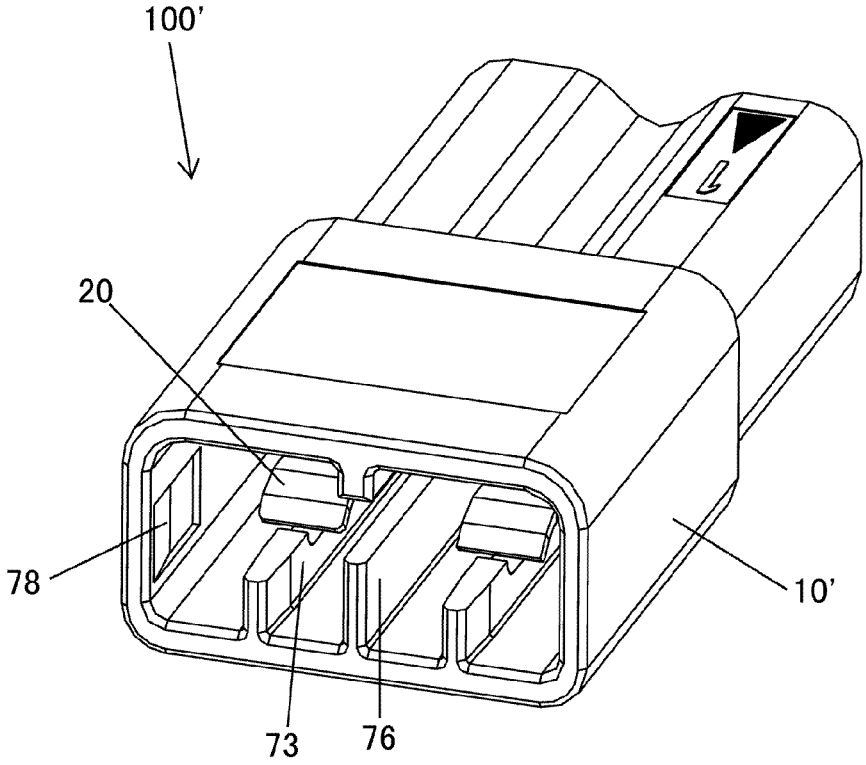
FIG. 3 is a perspective view of a socket connector.
Figure 4:
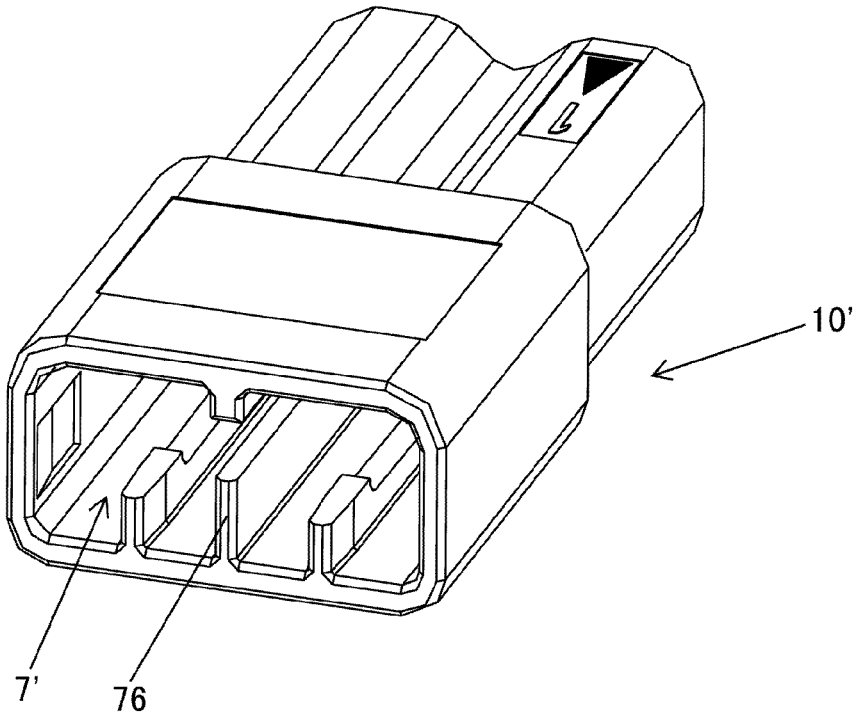
FIG. 4 is perspective view of a first end of a socket connector housing.

As shown in the embodiments of FIGS. 1-4, an electrical connector has a plug connector 100 for connecting a cable 300, as shown in FIGS. 1 and 2, and a socket connector 100' for connecting a cable, as shown in FIGS. 3 and 4. In the following description, if the electrical connector is the plug connector 100, the mating connector is the socket connector 100'; if the electrical connector is the socket connector 100', the mating connector is the plug connector 100.

The electrical connector includes: a plug connector housing 10 or 10' and a plurality of connection terminals 20 mounted inside the housing 10 or 10'. The housing 10 or 10' has a plurality of receiving passages extending through the housing in an insertion direction of the cable 300, where the insertion direction is along a longitudinal direction or a length direction of the electrical connector. The cable 300 is inserted into the cable receiving passage in the insertion direction.

With reference to the embodiments of FIGS. 6-9, the plurality of connection terminals 20 are made of metal sheet, such as copper, stainless steel, or other similar materials. The connection terminals 20 are detachably mounted inside the receiving passages. Each connection terminal 20 has a substantially flat terminal body 1, the cable 300 being inserted into the terminal body 1 in the insertion direction, and being electrically connected to the terminal body 1 (see FIG. 9). A contact arm 2 extends continuously from a mating end of the terminal body 1 along the insertion direction to electrically contact a complimentary mating terminal of a mating electrical connector. A cable fastening member 3 is positioned on the terminal body 1 on an opposite terminating end, and, together with the terminal body 1, grips and fixes the cable 300. A cable releasing member 4 formed on the cable fastening member 3 and constructed to operatively release the gripped cable 300.

With further reference to the embodiments of FIGS. 6-9, a cross-section of the terminal body 1 and the cable fastening member 3 on the terminating end, in a direction perpendicular to the insertion direction of the cable 300, has substantially U-shaped section, where an opening of the U-shaped section defines the cable releasing member 4. The cable 300 is separated from the connection terminal 20 through an operation of the cable releasing member 4.

In an embodiment, the connection terminal 20 has a cantilevered arm 31 extending from the cable fastening member 3 along the insertion direction, towards the mating end of the connection terminal 20. The cantilevered arm 31 extends obliquely from the cable fastening member 3 towards the terminal body 1. A free end of the cantilevered arm 31 has a sharp edge 32 for contacting the cable 300. A cable stop 11 is positioned on the terminal body 1 at a position distal to the cable fastening member 3 and proximate to the contact arm 2, limiting an insertion length of the cable 300. A conductor positioning member 12 extending in the insertion direction is positioned at a transition region between the cable fastening member 3 and the terminal body 1. After a portion of an insulation layer of the cable 300 has been removed and a corresponding portion of a conductor 301 has been exposed, the cable 300 is manually inserted into the connection terminal 20 in the insertion direction, into the substantially U-shaped space between the cable fastening member 3 and the terminal body 1. The conductor positioning member 12 assists in holding the cable 300 on the terminal body 1. When a terminating end of the cable 300 contacts the cable stop 11, the cable stop 11 prevents the cable 300 from being further displaced in the insertion direction, thus limiting the length of cable 300 inserted into the connection terminal 20.

Additionally, the terminal body 1 has at least one holding projection 14, positioned on two opposite edges respectively, which stably hold the connection terminals 20 inside the cable receiving passages of the housing 10 or 10'.

Figure 5:
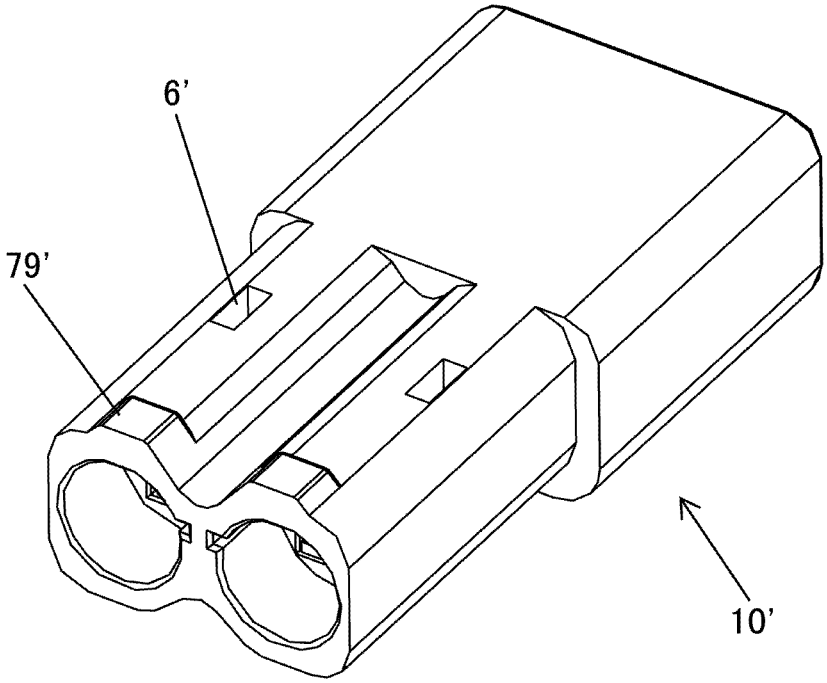
FIG. 5 is perspective view of a second end of the socket connector housing.
Figure 6:
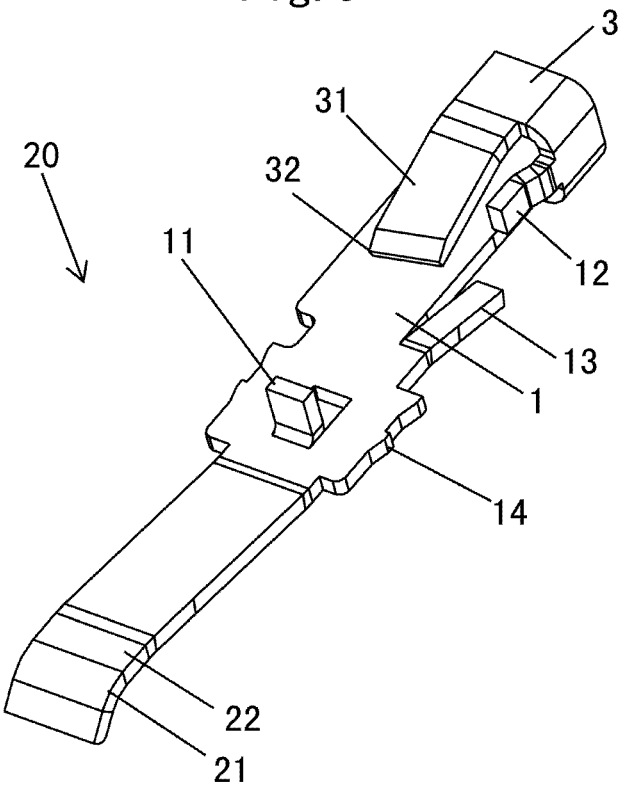
FIG. 6 is a perspective view of a first end of a connection terminal.
Figure 7:
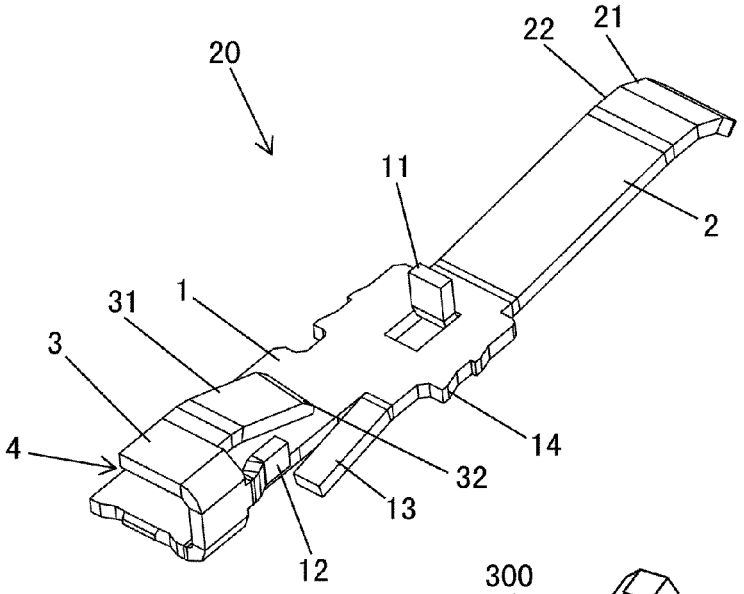
FIG. 7 is perspective view of a second end of the connection terminal.
Figure 8:
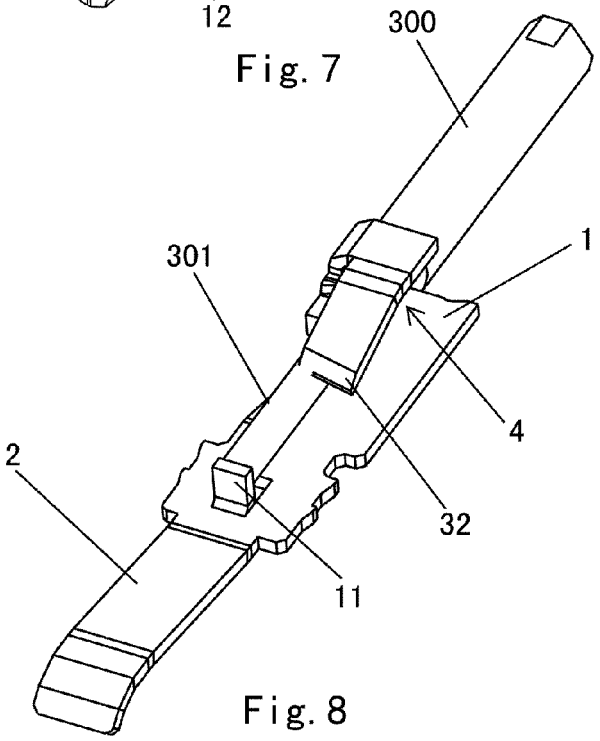
FIG. 8 is a perspective view of the first end of the connection terminal connected a cable.

In an embodiment, the terminal body 1 includes a terminal locking member 13, which extends from the terminal body 1 towards the terminating end, opposite to the insertion direction. Correspondingly, as shown in the embodiments of FIGS. 2 and 5, the housing 10 or 10' includes a locking member receiving hole 6 or 6', which extends from the receiving passageway to an outer surface of the housing 10 or 10' in a thickness direction perpendicular to the insertion direction. When the connection terminal 20 is position inside the housing, the terminal locking member 13 partially projects into the locking member receiving hole 6 or 6,' abutting against a wall of the locking member receiving hole 6 or 6' along the direction opposite to the insertion direction. The connection terminal 20 is thus prevented from moving in the direction opposite to the insertion direction. To remove the connection terminal 20 from the housing 10 or 10', a tool, such as a small screw-driver, may be inserted into the locking member receiving hole 6 or 6' and pressed against the terminal locking member 13 in the locking member receiving hole. (not shown) The terminal locking member 13 may then be displaced from the locking member receiving hole 6 or 6'. In this situation, a second tool may be used to push the connection terminal 20 out of the housing 10,10', or the cable 300 may directly pulled opposite the insertion direction so as to pull the connection terminal 20 out of the housing 10 or 10'.

Figure 9:
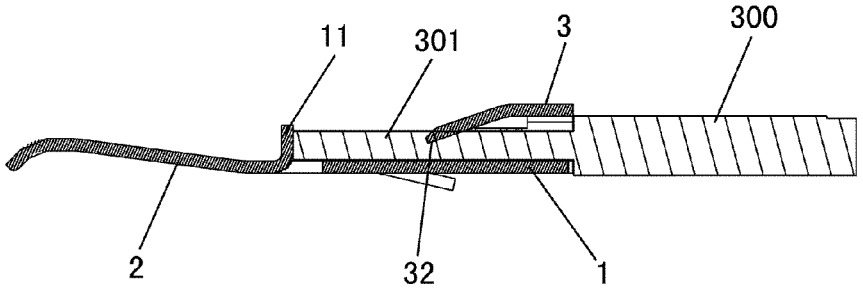
FIG. 9 is a longitudinal sectional view of FIG. 8.

As shown in an embodiment of FIG. 9, after the connection terminal 20 connected with a cable 300 is removed from the housing 10 or 10', the cable 300 may be rotated and moved towards the opening of the cable releasing member 4, and eventually removed from the connection terminal 20. Then, after installing a new cable into the connection terminal 20, the connection terminal 20 connected to the new cable may be reinserted into the housing 10 or 10'. Alternatively, one of ordinary skill in the art would appreciate that the connection terminal 20 without a cable 300 may be inserted into the housing 10 or 10' first, and the cable 300 may then subsequently be inserted and secured to the connection terminal 20.

Figure 11:
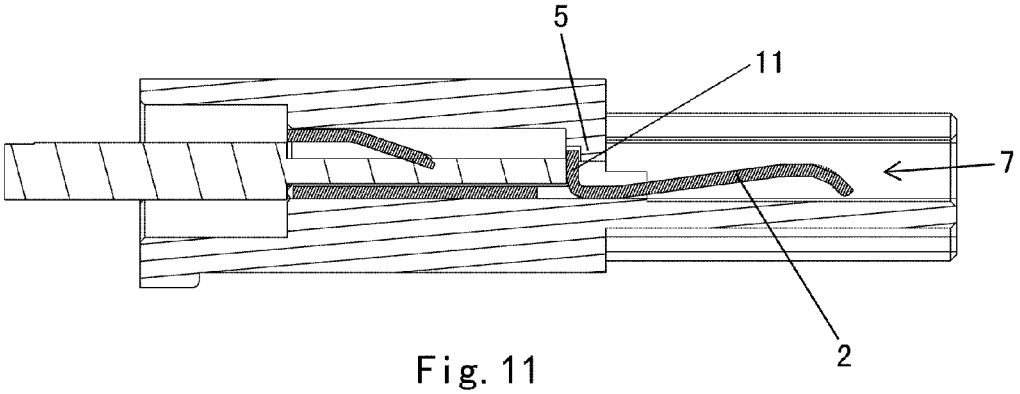
FIG. 11 is a longitudinal sectional view of a side of the plug connector of FIG. 1.
Figure 12:
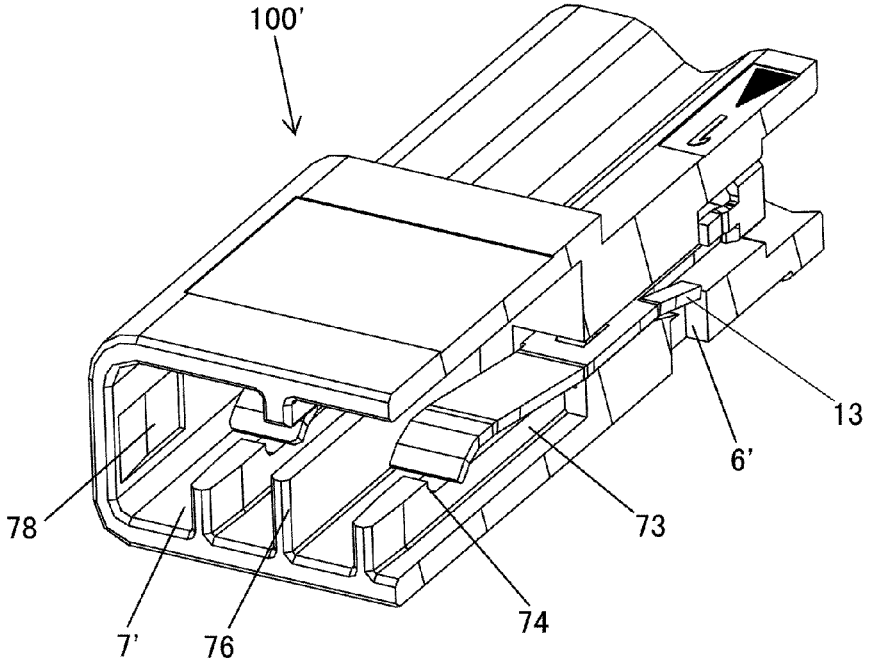
FIG. 12 is a longitudinal sectional view of the socket connector of FIG. 3.

As shown in the embodiments of FIGS. 11 and 12, the receiving passage of the housing 10 or 10' has a terminal stopping protrusion 5 or 5' therein, that is complimentary to the cable stop 11. When the connection terminal 20 is moved to a proper position along the insertion direction, the cable stop 11 of the connection terminal 20 abuts against the terminal stopping protrusion 5 or 5' in the insertion direction, preventing the connection terminal 20 from further moving in the insertion direction. Therefore, when the connection terminal 20 is moved to the proper position, the terminal locking member 13 of the connection terminal 20 is engaged with the locking member receiving hole 6 or 6', and the cable stop 11 is engaged with the terminal stopping protrusion 5 or 5', such that the front-back movement of the connection terminal 20 in the longitudinal direction is prevented and the connection terminal 20 is held in the housing 10 or 10'.

The plug connector 100, as shown in the embodiments of FIGS. 1 and 2 serving as the electrical connector, and the socket connector 100', as shown in an embodiment of FIG. 3 serving as the mating electrical connector, will be described hereinafter.

The socket connector 100' has a plurality of socket terminals, the structures of which are the same as that of the connection terminal 20. Therefore, the connection terminal 20 described above may be used not only in the plug connector 100 but also in the socket connector 100', reducing the manufacturing cost of the connection terminal.

In the embodiments of FIGS. 1, 2, 10 and 11, each receiving passage of the plug connector 100 includes a terminal receiving passageway 7, in which the contact arm 2 of the connection terminal 20 is positioned. Correspondingly, as shown in the embodiments of FIGS. 3, 4, 12 and 13, the socket connector 100' includes a plurality of socket receiving passageways 7', in which the contact arm 2 of the connection terminal 20, serving as a socket terminal, is positioned, and into which the terminal receiving passageway 7 may be inserted such that the contact arm 2 of the connection terminal 20 is electrically connected to the contact arm 2 of the socket terminal.

Figure 13:
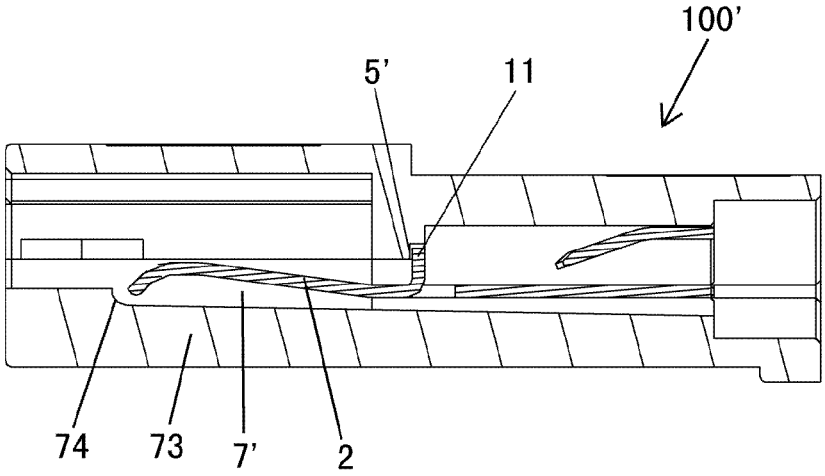
FIG. 13 is a longitudinal sectional view of a side of the socket connector of Figure.
Figure 14:
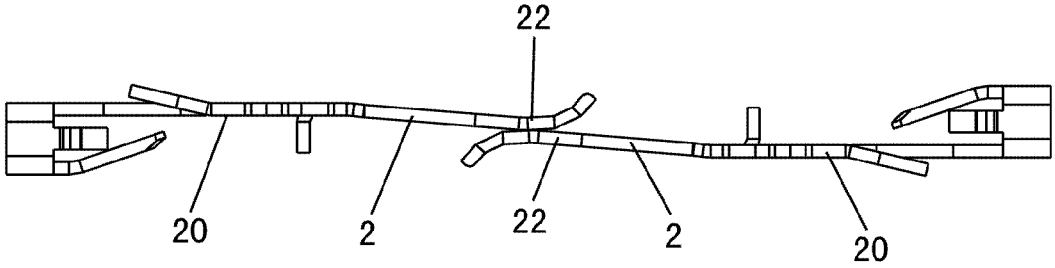
FIG. 14 is a sectional view of a connection state between the connection terminals when the plug connector is coupled with the socket connector.
Figure 15:
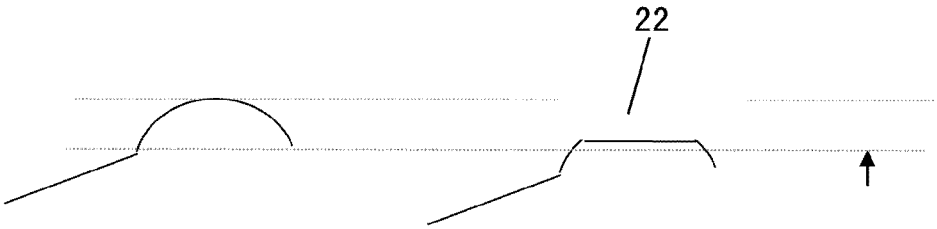
FIG. 15 is a schematic comparison between contact portions of the connection terminal of FIG. 14 and a conventional connection terminal.

As shown in the embodiments of FIGS. 1, 2, 10 and 11, the free end of the contact arm 2 of the connection terminal 20 abuts against a first wall 71 of the terminal receiving passageway 7. A guiding slot 72 extends along the insertion direction and is positioned on a second wall of the terminal receiving passageway 7 opposite to the first wall 71. Correspondingly, as shown in the embodiments of FIGS. 3, 12 and 13, a complementary guiding projection 73 is positioned on the socket receiving passageway 7', with the contact arm 2 of the socket terminal 20 being positioned on the guiding projection 73. A contact arm stopping projection 74 is positioned on the guiding projection 73 to block the free end of the contact arm 2 of the connection terminal 20. When mating the plug connector 100 and the socket connector 100' together, the guiding projection 73 may be displaced along the guiding slot 72 such that the contact arms 2 of the plug connector 100 and the socket connector 100' are mechanically and electrically connected to each other.

In an embodiment shown in FIGS. 6, 7 14 and 15, the free end of the contact arm 2 has an arc structure 21, and an angled, planar contact region 22 is formed in the vicinity of the arc structure 21. With reference to an embodiment of FIG. 14, when the plug connector 100 is engaged with the socket connector 100', the contact points of the contact arms 2 are located at the planar contact regions 22. With reference to the embodiment of FIG. 15, as compared with the continuously circular arc contact region of a traditional connection terminal, the planar contact region 22 remarkably increases the contact area, preventing the contact arm 22 from undergoing excessive deformation and ensuring that the eventual contact points are located at the tilting plane contact regions 22. Consequently, a holding force generated between two contact arms 2 is greatly increased, thus increasing a plug contact force of the resultant products while preventing excessive interference between the contact arms 2.

Figure 10:
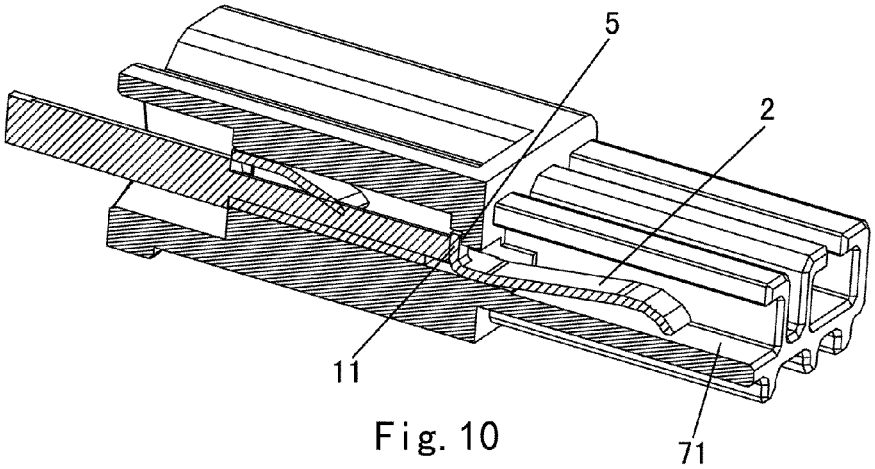
FIG. 10 is a longitudinal sectional view of the plug connector of FIG. 1.

In the embodiments of FIGS. 1, 2 and 10, a keyed groove 75 is positioned between two adjacent terminal receiving passageways 7. As shown in FIGS. 3 and 12, a complimentary keyed projection 76 is mated with the keyed groove 75, being positioned between two adjacent socket receiving passageways 7'. When the plug connector 100 is inserted into the socket connector 100', the unique shape of the keyed projection 76 fits into the complementary keyed groove 75 and is displaced along the length of the keyed groove 75, such that the contact arms 2 of the plug connector 100 and the socket connector 100' are mechanically and electrically connected to each other. If the keyed projection 76 cannot be positioned in the keyed groove 75, then the plug connector 100 cannot be inserted into the socket connector 100'. Therefore, the keyed projection 76 and the keyed groove 75 function both as mutual guides, as well as connector identifiers. Additionally, as shown in the embodiments FIGS. 2 and 5, a further identifying element 79 or 79' is provided on the housing 10 or 10', and the user may ensure whether the posture of the plug connector corresponds to the posture of the socket connector by observing the identifying elements 79 or 79'.

As shown in an embodiment of FIG. 2, a locking projection 77 is provided on an outer wall of at least one of the two terminal receiving passageways 7 at the outermost sides. Correspondingly, as shown in the embodiments of FIGS. 3 and 12, a complimentary locking projection receiving space 78 is positioned on one of the inner walls of the two socket receiving passageways 7' at the outermost sides, and mates with the locking projection 77. When the plug connector 100 is fully inserted into the socket connector 100', the locking projections 77 engage the locking projection receiving spaces 78, accomplishing a snap-fit engagement between the plug connector 100 and the socket connector 100'. As such, the plug connector 100 will not be separated from the socket connector 100' unless a large separating force is applied.

As shown in the embodiments of FIGS. 2 and 5-7, the terminal body 1 includes the terminal locking member 13, and the housing 10 or 10' includes the locking member receiving hole 6 or 6'. When the connection terminal 20 is positioned in the housing 10 or 10', the terminal locking member 13 partially extends into the locking member receiving hole 6 or 6' and abuts against the wall of the locking member receiving hole 6 or 6' in the direction opposite to the insertion direction. The connection terminal 20 is thus prevented from moving in the direction opposite to the insertion direction.

In another embodiment, the electrical connector is the socket connector 100' and the mating electrical connector is the plug connector 100 mated with the socket connector 100'. In this situation, the plug connector 100 includes a plurality of plug terminals, the structures of which is the same as that of the connection terminal 20.

In the electrical connectors according to above various embodiments discussed above, since the connection terminal may be removed from the housing by performing a removing operation, and since the cable releasing members are positioned on the connection terminal, a cable secured in the connection terminal may be removed by a simple operation without causing any damage to the connection terminal, thereby facilitating replacement of a damaged cable with a new cable. In this way, there is no need to discard the connection terminal with the damaged cable, and the connection terminal may be reused, saving the cost of the whole electrical connector.

Those of ordinary skill in the art would appreciate that the above embodiments are intended to be illustrated. Many modifications may be made to the above embodiments by those of ordinary skill in the art, and that various structures described in various embodiments may be freely combined with each other without conflicting in configuration or principle, such that on the basis of solving the problem of the present invention, other embodiments of connection terminals may be accomplished.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A connection terminal for releaseably connecting a cable, comprising:

a terminal body having a mating end and an opposite terminating end;

a contact arm extending continuously from the mating end of the terminal body, the contact arm having a free end having an arc structure and an angled, planar contact region positioned between the arc structure and the terminating end of the terminal body, the contact region contacting a mating connection terminal;

a cable fastening member positioned on the terminating end of the terminal body;

a cable releasing member positioned on the cable fastening member; and a cantilevered arm extending obliquely from the cable fastening member along an insertion direction of the cable towards the terminal body, the cantilevered arm having a free end with a sharp edge that contacts the cable.

2. The connection terminal of claim 1, wherein a cross-section of the terminal body and the cable fastening member on the terminating end is substantially U-shaped in a direction perpendicular to an insertion direction of the cable.

3. The connection terminal of claim 2, wherein an opening of the U-shaped section defines the cable releasing member.

4. The connection terminal of claim 1, wherein a conductor positioning member is positioned at a transition region between the cable fastening member and the terminal body, extending along the insertion direction.

5. The connection terminal of claim 1, wherein the terminal body includes at least one holding projection positioned on each of two opposite sides of the terminal body.

6. The connection terminal of claim 1, wherein a cable stop is positioned on the terminal body at a position distal to the cable fastening member and proximate to the contact arm, limiting an insertion length of the cable.

7. The connection terminal of claim 1, wherein the terminal body further includes a terminal locking member extending from the terminal body towards the terminating end, opposite to the insertion direction.

8. A plug connector, comprising:

a housing having a terminal receiving passageway; and a connection terminal disposed in the terminal receiving passageway for releasably contacting a cable, the connection terminal having a terminal body having a mating end and an opposite terminating end, a contact arm extending continuously from the mating end of the terminal body, the contact arm having a free end having an arc structure and an angled, planar contact region positioned between the arc structure and the terminating end of the terminal body, the contact region contacting a mating connection terminal, a cable fastening member positioned on the terminating end of the terminal body, a cable releasing member positioned on the cable fastening member, and a cantilevered arm extending obliquely from the cable fastening member along an insertion direction of the cable towards the terminal body, the cantilevered arm having a free end with a sharp edge that contacts the cable.

9. The plug connector of claim 8, wherein the housing has a locking member receiving hole extending from the terminal receiving passageway to an exterior of the housing in a thickness direction perpendicular to an insertion direction of the connection terminal.

10. The plug connector of claim 9, wherein the terminal body further includes a terminal locking member extending from the terminal body towards the terminating end, opposite to the insertion direction.

11. The plug connector of claim 10, wherein the terminal locking member is disposed in the locking member receiving hole.

12. The plug connector of claim 11, wherein, when the terminal locking member is disposed in the locking member receiving hole, the connection terminal is prevented from moving in a direction opposite to the insertion direction.

13. The plug connector of claim 8, wherein the housing has a terminal stopping protrusion disposed in the terminal receiving passageway.

14. The plug connector of claim 13, wherein the connection terminal has a cable stop positioned on the terminal body at a position distal to the cable fastening member and proximate to the contact arm, limiting an insertion length of the cable.

15. The plug connector of claim 14, wherein the cable stop abuts the terminal stopping protrusion, limiting an insertion of the connection terminal into the terminal receiving passageway along the insertion direction.

16. The plug connector of claim 8, wherein the free end of the contact arm abuts against a first wall of the terminal receiving passageway.

17. The plug connector of claim 8, wherein the housing has a guiding projection disposed in the terminal receiving passageway.

18. The plug connector of claim 17, wherein the contact arm is positioned on the guiding projection.

19. The plug connector of claim 18, wherein the housing has a stopping projection positioned on the guiding projection.

20. The plug connector of claim 19, wherein the stopping projection blocks the free end of the contact arm.

* * * * *